United States Patent [19]

Weixel

[11] Patent Number: 4,598,469

[45] Date of Patent: Jul. 8, 1986

[54] DOUBLE PINCH-PUSH CONTACT INSERTION END-EFFECTOR

[75] Inventor: Mark S. Weixel, Ellicott City, Md.

[73] Assignee: The United States of America as represented by the Secretary of the Air Force, Washington, D.C.

[21] Appl. No.: 675,173

[22] Filed: Nov. 27, 1984

[51] Int. Cl.[4] ..... H01R 43/00

[52] U.S. Cl. ..... 29/747; 29/739; 29/845

[58] Field of Search ..... 29/741, 739, 747, 748, 29/837–839, 844, 845

[56] References Cited

U.S. PATENT DOCUMENTS

| | | | |
|---|---|---|---|
| 3,143,790 | 8/1964 | Over et al. | 29/203 |
| 3,605,234 | 9/1971 | Bogursky | 29/203 H |
| 3,742,571 | 7/1973 | Brehm | 29/203 H |
| 4,044,451 | 8/1977 | Bunnell | 29/566.4 |
| 4,139,937 | 2/1979 | L'Homme | 29/754 |
| 4,171,566 | 10/1979 | Tominoi | 29/747 |
| 4,349,944 | 9/1982 | Fickes | 29/566.4 |
| 4,356,626 | 11/1982 | Waghorn | 29/747 |

*Primary Examiner*—Carl E. Hall

*Attorney, Agent, or Firm*—Donald J. Singer; Jacob N. Erlich; James E. Maslow

[57] ABSTRACT

A double pinch-push contact insertion end-effector for performing contact insertion on a universal basis. End-effector comprises a front jaw assembly which is moveable relative to a rear jaw assembly. Each jaw assembly comprises a pair of jaws, where each pair is individually actuable to effect contact insertion.

18 Claims, 5 Drawing Figures

FIG. 1
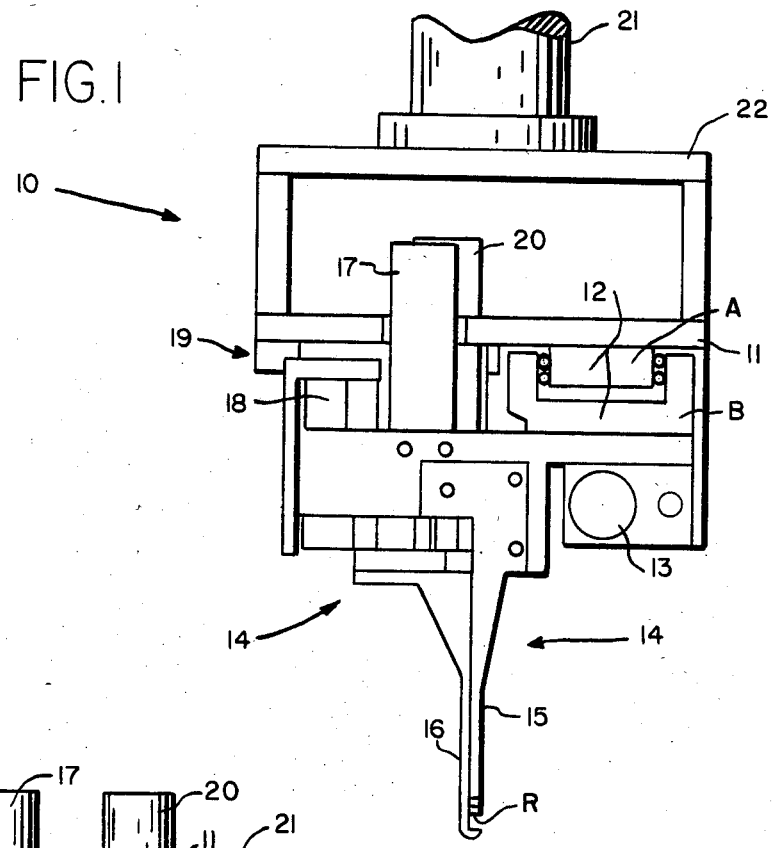
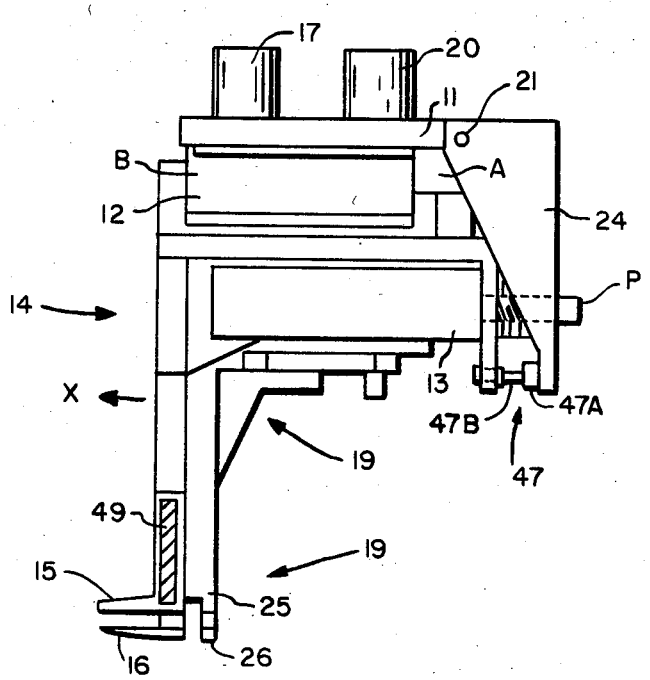
FIG. 2

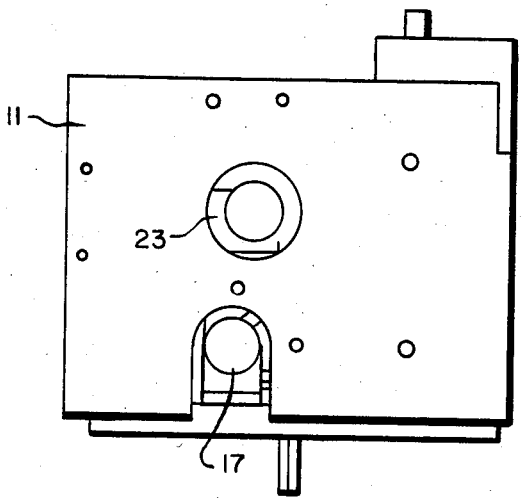
FIG.3
FIG.4
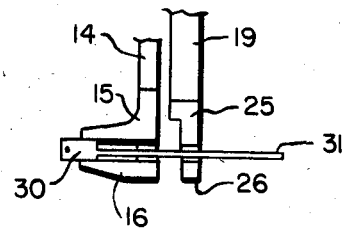
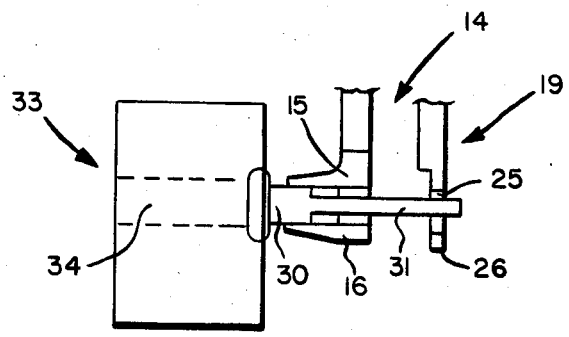
FIG.5

DOUBLE PINCH-PUSH CONTACT INSERTION END-EFFECTOR

STATEMENT OF GOVERNMENT INTEREST

The invention described herein may be manufactured and used by or for the Government for governmental purposes without the payment of any royalty thereon.

BACKGROUND OF THE INVENTION

The present invention relates to robotic assembly of wire harnesses, and, more particularly, to a contact-independent double pinch-push contact insertion end-effector for use in wire harness assembly.

Fully automatic production is a sought-after goal in cost-effective wire harness assembly. Such assembly preferably is achieved by means of a manipulable mechanism which can insert contacts of varying styles into connectors and which mechanism is articulable by means of a robot arm.

Insertion tools which are typically used when performing a contact insertion are contact dependent, i.e., dedicated to a particular contact style. Furthermore, the force required to insert a contact into a connector typically ranges from below one pound up to six pounds where the insertion force is dependent on the contact and connector combination used. Grommetless connectors have less resistance to contact insertion than do grommet connectors. Therefore lower insertion forces are encountered when performing a contact insertion into a grommetless connector (typically less than one pound) than into a grommet connector (typically greater than four pounds). Therefore, it is desirable that the same insertion tool be operable for both low and high insertion force applications, independent of contact style.

Such a versatile insertion tool preferably should be able to perform contact insertions for wires prepared by attaching crimp contacts, such as per MIL-C-39029, where prepared wire gauges range from 16 to 24, with an insulation wall thickness of 0.003 to 0.010 inch.

Because it is not possible to have a fully sequenced contact insertion routine for all connectors, the insertion tool must have the capability to perform random contact insertions. A random contact insertion involves interference with the wires of previously inserted contacts during positioning of the insertion mechanism to effect such random contact insertion.

Furthermore, it is additionally desirable that the insertion tool be able to perform a tug test. A tug test is performed by pulling on the wire of the inserted contact to verify proper seating of the contact. A properly seated contact is locked into the connector and cannot be removed unless an extraction tool is used. It is also desirable that the tug test capability be available as an aid during the contact insertion process, such as for force monitoring.

SUMMARY OF THE INVENTION

It is therefore an object of the present invention to provide a contact-independent end-effector for use in wire harness manufacture.

It is another object of the present invention to provide a contact-independent end-effector for use in wire harness assembly capable of pinch-push manipulation.

The present invention comprises a contact-independent double pinch-push contact insertion end-effector. The end-effector comprises a front jaw assembly and a rear jaw assembly, and is attached to a robot arm for articulation, i.e. movement.

The front jaw assembly can be extended and retracted relative to the rear jaw assembly. This is accomplished by mounting the front jaw asembly to a ball slide, the latter of which is attached to a base plate. An actuating air cylinder is coupled between the ball slide and the base plate for control of extension and of retraction of the front jaw assembly relative to the rear jaw assembly. The rear jaw assembly is fixed to the base plate. The amount of extension (stroke length) of the front jaw assembly can be varied by adjustment of a stop.

The front jaw assembly comprises an upper jaw and a lower jaw, where this jaw pair is coupled to a ball slide. The jaw pair is opened and closed by actuating an air cylinder. A taper is provided on at least one jaw to enable accurate registration of the contact relative to the gripper during contact loading and subsequent contact insertion, and at least one lower jaw is shaped to deflect the wires of previously inserted contacts. The end-effector, loaded with a contact, is designed to be lowered into a bundle of wires to a specified height amongst wires of previously inserted contacts for performance of contact insertion.

The rear jaw assembly comprises an upper jaw and a lower jaw. This latter jaw pair is operated by an air cylinder coupled in cooperation with another ball slide.

DESCRIPTION OF THE DRAWINGS

The invention will be more clearly understood by reference to the following detailed description of a preferred embodiment thereof in conjunction with the accompanying drawings, in which:

FIG. 1 is a front view of the present invention;

FIG. 2 is a right side view of the embodiment of FIG. 1, rotated 90 degrees left, with the robot arm 21 and the housing 22 not shown;

FIG. 3 is a top view of the embodiment of FIG. 1, with the robot arm 21 and housing 22 not shown;

FIG. 4 is a broken view showing a contact affixed to a wire being held between the closed jaws of the front and rear jaw assemblies; and FIG. 5 is a broken view showing the elements of FIG. 4 but where the contact is being inserted into a connector.

DESCRIPTION OF PREFERRED EMBODIMENT

Referring now to FIGS. 1, 2 and 3, there is shown a front, right side and top view, respectively, of a preferred embodiment of the double pinch-push contact insertion end-effector 10 of the present invention. End-effector 10 comprises a front jaw assembly 14 and a rear jaw assembly 19, both of which assemblies are coupled by means of base plate 11 and housing 22 to an articulating, i.e. moving robot arm 21.

In the preferred embodiment of FIGS. 1, 2 and 3, the front jaw assembly 14 is extendable and retractable relative to rear jaw assembly 19 by means of a ball slide assembly 12. The direction of movement of front jaw assembly 14 is indicated by the arrow "X" shown in FIG. 2.

The ball slide assembly 12 comprises a "u" shaped track B cooperating with a slide A. These elements cooperate to facilitate movement relative to base plate 11 of front jaw assembly 14 along the longitudinal axis of ball slide 12. Front jaw assembly 14 is preferably mounted on track B, while slide A is affixed to base plate 11. Also affixed to track B is the body of an air cylinder 13, whose piston end P is tied to base plate 11 by means of rigid mounting plate 24, the latter being affixed to base plate 11 at connection 21.

Rear jaw assembly 19 is also fixedly coupled to base plate 11, such that actuation of air cylinder 13 will cause front jaw assembly 14 to travel, relative to location of the rear jaw assembly 19 along the aforesaid ball slide longitudinal axis.

Both jaw assemblies 14, 19 are each provided with a pair of jaws. The upper jaw 15 and lower jaw 16 of front jaw assembly 14 are shown in FIGS. 1 and 2. The body of an air cylinder 17 is fixedly mounted to front jaw assembly 14, while the cylinder piston is mechanically coupled to at least one of upper jaw 15 and lower jaw 16 to enable opening and closing movement of upper jaw 15 and lower jaw 16 relative to each other.

The upper jaw 25 and lower jaw 26 of rear jaw assembly 19 are shown in FIG. 2. Upper jaw 25 and lower jaw 26 are coupled to rear jaw assembly 19. The body of an air cylinder 20 extends through an opening in base plate 11 and is fixedly mounted to base plate 11 via bracket 23 (which bracket is shown in FIG. 3), while the cylinder piston is mechanically coupled to at least one of upper jaw 25 and lower jaw 26 to enable opening and closing movement of upper jaw 25 and lower jaw 26 relative to each other.

Referring now to FIGS. 4 and 5, a partial side view of front jaw assembly 14 and rear jaw assembly 19 is shown, where a contact 30 and wire 31 are shown disposed between jaw pairs 15, 16 and 25, 26, respectively, for contact insertion. In FIG. 4, front jaw assembly 14 and rear jaw assembly 19 are shown in abutting condition prior to contact insertion. In FIG. 5, the front jaw assembly 14 is shown in extended position, where assemblies 14 and 19 are shown during insertion of contact 30 into connector 33 at connector opening 34, and where contact 30 is shown in partially inserted condition.

In one embodiment, articulation, i.e. movement of jaw pairs 15, 16 and 25, 26 may be accomplished by coupling air cylinders 17 and 20, respectively, to the respective jaw pairs via ball slides. Exemplary ball slide assembly 18 is shown in FIG. 1, where its base is mounted to front jaw assembly 14, to which air cylinder 17 is also tied. The piston end of cylinder 17 is coupled to either or both of jaws 15, 16. A like arrangement may be provided between jaws 25, 26 and cylinder 20. Furthermore, a translating mechanism may be employed to translate displacement of the ball slide into symmetrically opposed displacement of each of the jaws of the jaw pair of the front or rear jaw assembly, as desired.

As will now be appreciated, the double pinch-push contact end-effector 10 is capable of performing contact insertions on a universal basis, i.e., independent of contact style. It is intended to be a rugged end-effector, which never enters the connector, compared to the fragile insertion tools which must enter the connector and are contact dependent. As well, the present invention is only dependent on a robot arm for remote positioning. This tends to decrease the cycle time required in which to perform a contact insertion and also simplifies the contact insert process. The end-effector has a random insertion capability and can also perform a tug test to verify proper contact seating. The force and position monitoring of the front jaw assembly will aid the contact insertion process.

Accurate placement of the contact with respect to the end-effector jaws can be assured by providing a recess at least on the upper jaws 15, 25 of front and rear jaw assemblies 14 and 19, respectively. An exemplary recess R is shown in FIG. 1 provided in upper jaw 15, which recess R extends longitudinally therein. A like recess may be provided in jaws 16, 25 and 26.

The stroke length of front jaw assembly 14 can be varied by adjusting a stop (not shown). For example, this stop may be located on ball slide 12. This will allow adjusting the stroke length of front jaw assembly 14 for optimal performance.

The end-effector is preferrably pneumatically driven where the insertion process is dependent on the actuation of the above air cylinders 13, 17, and 20. The coordinated action of the front and rear jaw assemblies will enable performing contact insertion while maintaining wire 31 in a known location.

The following is an exemplary sequence of operation of the present invention:

1. The robot arm 21 positions the end-effector 10 so that contact 30 and wire 31 (to which the contact is affixed) are respectively located between the open jaws 15, 16 and 25, 26.
2. The jaws 15, 16 and 25, 26 of the end-effector are then closed. Now the securely held contact 30 extends slightly beyond the tip of the front jaw assembly 14, as seen in FIG. 4.
3. The robot arm 21 places the end-effector 10 directly adjacent opening 34 of fixtured connector 33 in which the contact insertion is to take place. (If the end-effector is lowered into a bundle of wires, the wires directly below the jaws are deflected to the side of the jaws by means of the tapered configuration of the jaw assembly as seen in FIG. 1.)
4. The rear jaws 25, 26 are opened and the front jaws are extended forward. Now the contact 30 is partially inserted within opening 34 of connector 33 and the tip of the front jaw pair 15, 16 nearly touches the body of connector 33, as seen in FIG. 5.
5. The rear jaw pair is closed. The wire 31 is now held in a known location while the front jaw assembly 14 prepares to repeat it's insertion sequence.
6. The front jaw pair is opened and retracted.
7. The front jaw pair is closed.
8. The rear jaw pair is opened and the front jaw assembly is extended. This latter action causes the contact to be inserted further into the connector, a distance equal to the set stroke length of the front jaw assembly 14.
9. This double pinch-push sequence is continued until the contact is properly seated in the connector.
10. A tug test is performed.

Returning now to FIG. 2, a linear voltage displacement transducer (LVDT) 47 is shown attached to end-effector 10 for monitoring the position of the front jaw assembly (relative to the rear jaw assembly). Utilizing the LVDT enables evaluation of contact insertion, including detection of a jammed contact as would prevent a successful insertion. More particularly, LVDT monitor 47 is shown in FIG. 2 affixed between base plate 11 (via plate 24) and front jaw assembly 14 for such application. As well, the LVDT may be supplemented by strain gauges. An exemplary strain gauge 49 is shown in FIG. 2 mounted on front jaw assembly 19. Further details of use and application of the LVDT and strain gauges are omitted herein, but merely for ease of disclosure, inasmuch as their general use and application are known to those skilled in the art.

Also, as seen in FIG. 2, upper and lower jaw pairs 15, 16 and 25, 26 articulate, i.e. move open vertically. In an alternative embodiment, these jaw pairs may be articulated, i.e. moved open and closed horizontally.

Furthermore, while ball slides and pneumatic actuators have been described herein, other bearing devices and actuators are within the spirit and scope of the present invention, and while the present invention has been described in connection with rather specific embodiments thereof, it will be understood that many more modifications and variations will be readily apparent to those of ordinary skill in the art and that this application is intended to cover any adaptation or variation thereof. Therefore, it is manifestly intended that this invention be only limited by the claims and the equivalents thereof.

What is claimed is:

1. A double pinch-push contact insertion end-effector comprising:

a base plate;

a front jaw assembly having a first pair of jaws;

a rear jaw assembly fixedly mounted to said base plate and having a second pair of jaws;

first means for moving said first jaw assembly relative to said rear jaw assembly, said first means including a ball slide slideably coupled between said front jaw assembly and said base plate and an actuator actively coupled between said front jaw assembly and said base plate;

second means for actuating closure of said first pair of jaws; and third means for actuating closure of said second pair of jaws.

2. The end-effector of claim 1, wherein said actuator comprises an air cylinder.

3. The end-effector of claim 1, wherein said actuator comprises a hydraulic cylinder.

4. The end-effector of claim 1, wherein said second means comprises a ball slide and an actuator.

5. The end-effector of claim 1, wherein said second means comprises a translating mechanism for symmetrical jaw movement and a ball slide.

6. The end-effector of claim 5, wherein said second means further comprises an actuator actively coupled to said ball slide.

7. The end-effector of claim 1, wherein said third means comprises a ball slide and an actuator.

8. The end-effector of claim 1, wherein said third means comprises a translating mechanism for symmetrical jaw movement and a ball slide.

9. The end-effector of claim 8, wherein said third means further comprises an actuator actively coupled to said ball slide.

10. The end-effector of claim 1 wherein said first pair of jaws and said second pair of jaws each comprise an upper and lower jaw, at least one of said jaws defining therein a longitudinal contact-receiving recess.

11. The end-effector of claim 1, further comprising an LVDT coupled between said base plate and said front jaw assembly.

12. The end-effector of claim 11, further comprising at least one strain gauge mounted on said front jaw assembly.

13. A double pinch-push contact insertion end-effector comprising:

a front jaw assembly having a first pair of jaws, a rear jaw assembly having a second pair of jaws, first means for moving said front jaw assembly relative to said rear jaw assembly, comprising a first ball slide and a first actuator, second means for actuating closure of said first pair of jaws, comprising a second ball slide and a second actuator, third means for actuating closure of said second pair of jaws, comprising a third ball slide and a third actuator, a base plate, wherein said rear jaw assembly is fixedly mounted to said base plate, and further comprising means to vary the stroke length of said front jaw assembly.

14. The end-effector of claim 13, wherein said second means further comprises a first translating mechanism for symmetrical jaw movement mounted between said second ball slide and said first pair of jaws.

15. The end-effector of claim 14, wherein said second means further comprises an actuator actively coupled to said second ball slide.

16. The end-effector of claim 13, wherein said third means further comprises a second translating mechanism for symmetrical jaw movement mounted between said third ball slide and said second pair of jaws.

17. The end-effector of claim 16, wherein said third means further comprises an actuator actively coupled to said third ball slide.

18. The end-effector of claim 13, wherein said first pair of jaws and said second pair of jaws each comprise an upper and lower jaw, each of said upper jaws further defining therein a longitudinal contact-receiving recess, further comprising an LVDT coupled between said base plate and said front jaw assembly, and at least one strain gauge actively mounted on said front jaw assembly.

* * * * *